US005716223A

United States Patent [19]

Phillips, Jr. et al.

[11] Patent Number: 5,716,223

[45] Date of Patent: Feb. 10, 1998

[54] SPARK PLUG BOOT INSULATOR

[75] Inventors: William Thomas Phillips, Jr., Boardman; Michael James Bezusko; Vincent James Tura, Jr., both of Warren, all of Ohio

[73] Assignee: General Motors Corporation, Detroit, Mich.

[21] Appl. No.: 609,067

[22] Filed: Feb. 29, 1996

[51] Int. Cl.[6] ..... H01R 13/44

[52] U.S. Cl. ..... 439/125; 439/890

[58] Field of Search ..... 439/125, 126, 439/127, 128, 890

[56] References Cited

U.S. PATENT DOCUMENTS

| | | |
|---|---|---|
| 2,398,359 | 4/1946 | Curtiss . |
| 3,881,051 | 4/1975 | Norman . |
| 4,497,532 | 2/1985 | Bezusko et al. . |
| 4,671,586 | 6/1987 | DeBolt . |
| 4,715,337 | 12/1987 | Bohl et al. . |
| 4,810,198 | 3/1989 | Sturdevan . |
| 4,997,380 | 3/1991 | Etienne et al. . |
| 5,127,840 | 7/1992 | Bezusko et al. . |
| 5,163,838 | 11/1992 | Tura, Jr. et al. . |
| 5,178,550 | 1/1993 | Fusselman et al. . |
| 5,370,100 | 12/1994 | Benedikt et al. . |
| 5,409,388 | 4/1995 | Phillips, Jr. et al. . |

FOREIGN PATENT DOCUMENTS

| | | |
|---|---|---|
| 225190 | 6/1987 | European Pat. Off. . |
| 0619631 | 10/1994 | European Pat. Off. . |
| 817034 | 7/1959 | United Kingdom . |

*Primary Examiner*—Khiem Nguyen
*Assistant Examiner*—Eugene G. Byrd
*Attorney, Agent, or Firm*—Michael J. Bridges

[57] ABSTRACT

A spark plug boot assembly for interfacing an ignition signal conductor and a spark plug, the assembly including a spark plug boot having a hollow electrically conductive cylinder disposed on an interior boot surface, the cylinder having a flared lower cylinder end extending through the interior boot surface over a spark plug post-socketed terminal contact area, and having an upper cylinder end extending over the socketed terminal including over any crimp section of the socketed terminal. The cylinder further includes a seat for seating a collar about the socketed terminal when a full terminal insertion position is reached.

12 Claims, 4 Drawing Sheets

SPARK PLUG BOOT INSULATOR

FIELD OF THE INVENTION

This invention relates to spark plug boots and, more particularly, to electrical, mechanical and dielectric insulation of connections between ignition coils and spark plugs.

BACKGROUND OF THE INVENTION

Spark plug boots are well-established as an interface between ignition cables and spark plugs preferably with a highly reliable electrical, mechanical, and dielectric connection between the terminal of ignition cables and the spark plugs over a long life and over potentially a great number of boot-plug separations and reattachments. Conventional spark plug boots have significant shortcomings. Electrical terminals within the boot are prone to deformation and damage over the life of the interface from the many likely boot-plug separations and reattachments. The electrical seal between elastomeric boots and spark plug insulators on spark plug necks can break down, for example from tearing of the elastomer upon boot removal due to boot-insulator adhesion or from loss of seal pressure due to compression set of the elastomeric boot. Insulator ribs have been proposed to overcome such loss of electrical seal which add air gaps or passages between the insulator and the boot. Such ribs increase the distance between the ignition cable terminal and the spark plug shell. Air within such gaps or passages is ionized at system operating voltages resulting in corona discharge along the interface between the boot and the insulator which can lead to premature dielectric breakdown of the boot to plug interface. The potential for such breakdown leads to reduced available voltage and reduction in ignition timing controllability and robustness. Lubricants, such as silicone grease, have been applied in the spark plug insulator-boot wall interface to minimize boot damage. Such lubricants can degenerate over time, and especially under the severe electric field stress associated with conventional designs. Conventional ignition cable terminals typically have irregular geometries which create high potential gradients with corresponding high E-field intensities. High E-field intensities can generate corona discharge which accelerates boot and lubricant degradation and shortens the life of the boot as a dielectric insulator.

The shortcomings associated with such known ignition interfaces can lead to shortened effective life of the interface and costly performance deterioration and part replacement. It would therefore be desirable to provide a reliable interface between ignition cable and a spark plug having a long life undiminished by corona discharge, boot tearing, and terminal deformation.

SUMMARY OF THE INVENTION

The present invention provides a desirable ignition interface between an ignition cable or an ignition source and a spark plug, characterized by long life and reduced sensitivity over prior art interfaces to such conditions as corona discharge and repeated removal and reattachment of the boot.

More specifically, an electrically conductive cylinder is molded or press fit into the boot and designed to extend over contact regions associated with severe electrical stress to act as a electric field (E-field) insulator for reducing the stress and the corona discharge in such regions. The cylinder is provided with a smooth interior and exterior surface to minimize areas of E-field concentration. Spark plug interface assembly contact regions of irregular physical geometry such as crimp areas between ignition cables and electrical terminals and such as contact areas between electrical terminals and spark plug posts are encapsuled within the smooth cylinder to likewise distribute E-field stress and reduce E-field concentration along the assembly, reducing potential for corona discharge. Higher ignition drive voltage can then be applied for improved ignition controllability without sacrificing boot durability.

A molded-in feature is provided in accord with a further aspect of the invention, in which a cylinder end is flared and molded into the spark plug boot material, which may be elastomeric material. The flared cylinder end extends over an electrical contact region within the boot where a spark plug post electrically contacts an ignition cable terminal. Such molded-in feature confines expansion of the boot in the electrical contact region, reducing the detrimental effect of the compression set characteristic of the boot and stabilizing sealing pressure normal force, resulting in increased dielectric seal robustness.

In accord with yet a further aspect of this invention, the cylinder is constructed and positioned within the boot to act as a heat sink across a substantial length of the boot to disperse heat from external sources, increasing the functional operating temperature of the boot assembly. In accord with still a further aspect of this invention, the cylinder is constructed and positioned to act as a boot strengthening member, stiffening the boot and improving boot assembly robustness in the face of repeated removals and re-attachments.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
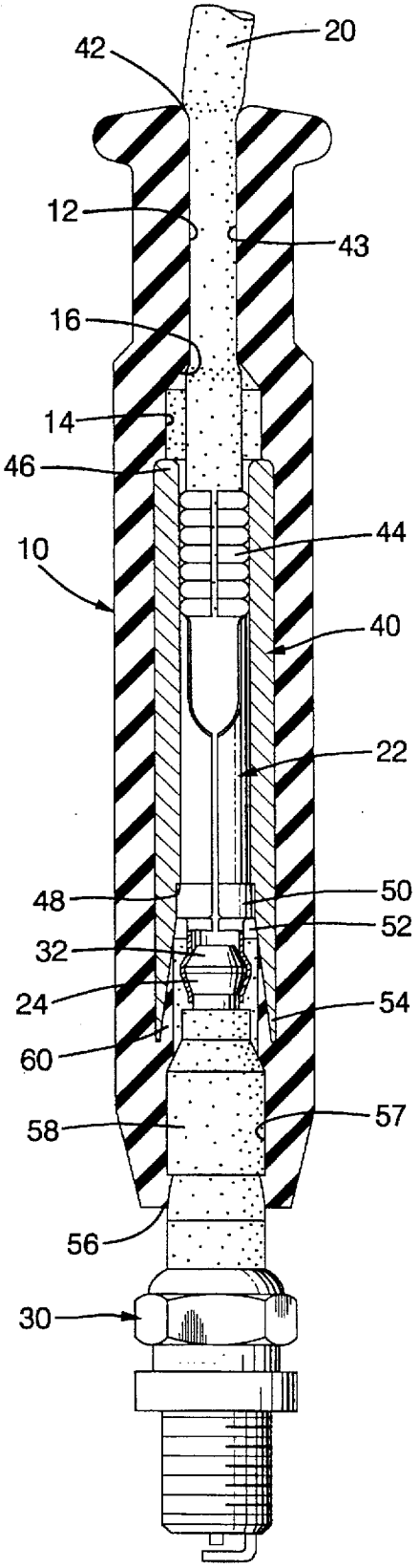
FIG. 1 is a front cutaway diagram of an assembly of the spark plug boot of this embodiment with a spark plug and ignition cable.

Referring to FIG. 1, a front cutaway diagram of a spark plug boot assembly illustrating a preferred installation of an elastomeric spark plug boot 10 with a conventional spark plug 30 having a ceramic insulator 58 extending outward therefrom and from the top of which extends spark plug post 32 and with an ignition cable 20 of conventional design, such as a high energy T.V.R.S. cable with a non-metallic conductive core and a high temperature silicone insulating jacket. An ignition coil, dedicated to electrical energization of the spark plug 30 may be installed at an upper end of the boot 10 in place of the ignition cable 20 in a wireless coil-at-plug ignition system embodiment of this invention, by modifying the upper end of the boot to securely receive a coil housing with an electrically conductive member extending from the coil output through the boot 10 for electrical engagement with the spark plug post 32. FIG. 8, to be described, illustrates such a coil-at-plug embodiment within the scope of this invention.

Returning to FIG. 1, spark plug boot 10 has a central longitudinal bore including an upper bore 12 (FIG. 2) graduating, via tapered bore section 16, into a lower bore 14 of slightly greater diameter than upper bore 12. The upper bore 12 is of diameter matched with the outer diameter of insulating jacket of cable 20 to provide for an air-tight, water-tight dielectric seal 42 therebetween to prevent passage of contaminants further into the upper bore 12. The lower bore 14 is of diameter matched with the diameter of spark plug insulator 58 such that an air-tight, water-tight dielectric seal is formed therebetween to prevent passage of contaminants further into the lower bore 14.

A flared, electrically conductive hollow metallic cylinder 40 having an upper end 46 and a lower end 54 opposing the upper end, the lower end having a flared internal diameter, is insert molded into the lower bore 14 with the internal surface of the cylinder 40 exposed in the lower bore 14. A molded-in feature is provided in which the flared lower end 54 is molded into the elastomer material of the boot 10, wherein elastomer material of the boot is interposed between the lower end 54 and the lower bore 14. The molded-in feature operates to confine expansion of the elastomeric material of the boot 10 in a critical sealing area near the electrical contact between a snap ring 24 and the spark plug post 32. The durability of the dielectric seal of the boot 10 is thereby improved in the area of such electrical contact by reducing the compression set characteristic which reduces sealing pressure normal force.

Ignition cable 20 is attached to socketed terminal 22 at mechanical crimp section 44. The crimp section 44 may take on any conventional geometry that corresponds to the structure of the cable 20 to provide for robust electrical conductivity between the socketed terminal 22 and the cable 20 and to provide for maximum mechanical retention of the cable 20 within the socketed terminal 22. The socketed terminal 22 has a conductive snap ring 24 made of heat treated spring steel sized to snap onto conventional spark plug post 32, thereby providing tactile feel and positive attachment with the spark plug post 32 when the assembly including the boot 10 and cable 20 is installed with the spark plug 30. Socketed terminal 22 is sized to securely contact the cylinder 40 for robust electrical conductivity therebetween. The mechanical crimp section 44 is internal to the cylinder 40 to relieve electrical field stress on the interface between the cable 20 and the boot 10. Surrounding the socketed terminal 22 and electrically connected thereto is a circular conductive collar 50, securely positioned on the socketed terminal between the mechanical crimp section 44 and the ring 32. The internal surface of the cylinder 40 includes a positioning feature 48 for seating the collar 50 during an assembly process, the positioning feature 48 taking the form of a circumferential collar seat, such as a step along the otherwise smooth interior surface of the cylinder 40 and positioned along the longitudinal axis of the cylinder 40 between the upper and lower cylinder ends 46 and 54, respectively, to snugly seat the collar 50 when the cable 20 is fully installed within the boot 10 through a conventional pull-to-seat installation procedure. The cylinder 40 further provides for a clearance spacing 52 between the boot 10 and the snap ring 24 of the socketed terminal 22 to reduce or eliminate mechanical boot damping during assembly which can blur the tactile feel of the positive engagement of the snap ring 24 with the spark plug post 32.

In accord with an important aspect of this invention, the cylinder 40 extends, at its flared lower end 54, significantly over the area of the electrical connection between the spark plug post 32 and the snap ring 24 of the socketed terminal 22, providing a significant electric field (E-field) stress reduction. Specifically, the E-field stress on the elastomeric boot 10 to spark plug insulator interface 56 is reduced through a reduction in corona discharge, thereby improving interface 56 durability. Further, E-field stress on any lubricant applied in the interface 56 is reduced, increasing the useful life of the lubricant and therefore of the boot 10 in the area of the interface 56.

The smooth surface of the cylinder 40 further provides for complete encapsulation of the irregular geometry of the spark plug terminal, thereby reducing the generation of corona discharge therefrom. Breakdom of the boot 10 from such discharge is relieved, increasing boot life. The cylinder further provides for a wide and relatively even distribution of the E-field stress within the lower bore 14 when the cable-plug connection is as operating voltage, improving the dielectric puncture resistance of the boot 10. The boot is then better able to endure increased ignition excitation voltages for increased ignition controllability and robustness or, alternatively, to contain a given ignition excitation voltage with less boot dielectric insulator material. The cylinder 40 further acts as a heat sink which broadly distributes heat from external heat sources, increasing the functional operating temperature of the spark plug-ignition cable connection in the boot 10. Still further, the stiff metallic cylinder 40 structure strengthens the boot 10 and stiffens the connection between the ignition cable 20 and the spark plug 30, providing for an interface better able to withstand the stress of repeated boot detachment and reattachment.

Figure 2:
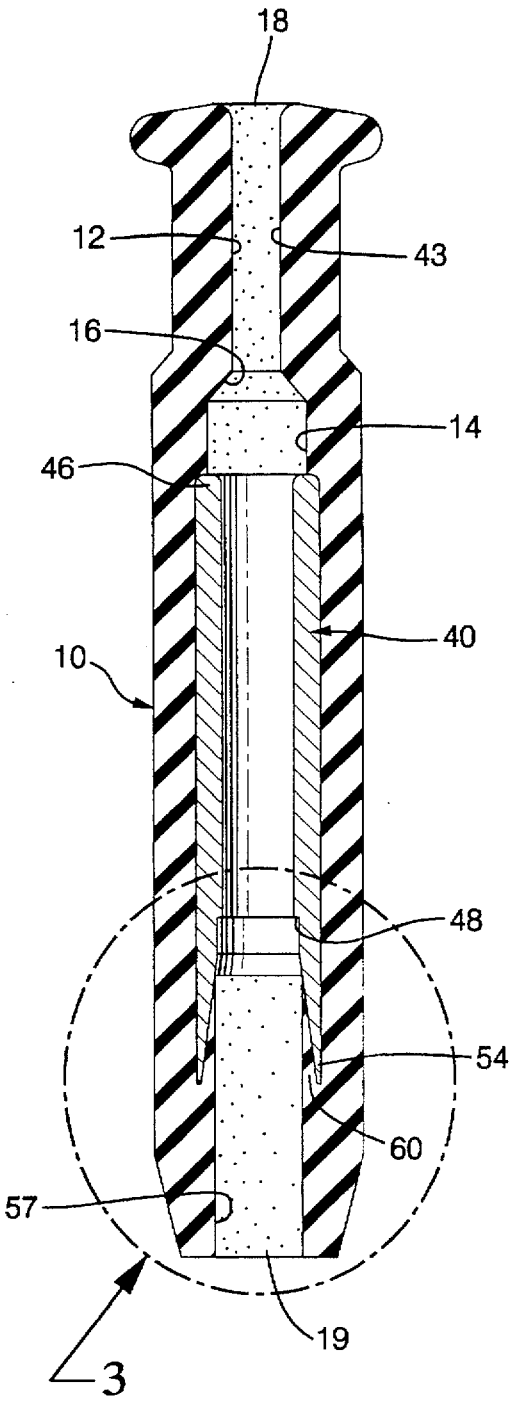
FIG. 2 is a front cutaway diagram of the spark plug boot of FIG. 1.

Referring to FIG. 2, a front cutaway view of the boot 10 of FIG. 1 details the upper bore 12 forming an upper aperture 18 at the boot top for receiving an ignition cable 20 (FIG. 1) during an assembly procedure with the insulating jacket of the cable sealingly associated with an interior wall 42 of the upper bore 12. The interior wall 42 of the upper bore 12 graduates along tapered bore section 16 to a lower bore 14 of increased diameter with a lower bore wall 57 for sealed engagement with the insulator of a spark plug 30 (FIG. 1), as described. The lower bore forms a lower aperture 19 at the boot bottom for receiving the spark plug 30 (FIG. 1). Hollow, flared, electrically conductive cylinder 40 is insert molded in the interior of the lower bore 14 against the lower bore wall 57 with an upper end 46 of the cylinder 40 well above the mechanical crimp section 44 (FIG. 1) and with flared lower end 44 of the cylinder 40 molded into the interior of the elastomeric material of the boot 10, wherein the boot 10 material is interposed at position 60 between the flared lower end 44 and the lower bore wall 57. The internal surface of the cylinder 40 includes a positioning feature 48 for seating the collar 50 (FIG. 1) during an assembly process, in the form of a circumferential collar seat 48 along the otherwise smooth interior surface of the cylinder 40 and positioned along the longitudinal axis of the cylinder between the upper and lower ends 46 and 54, respectively, to mate with the collar 50 (FIG. 1) when the cable 20 (FIG. 1) is fully installed within the boot 10.

Figure 3:
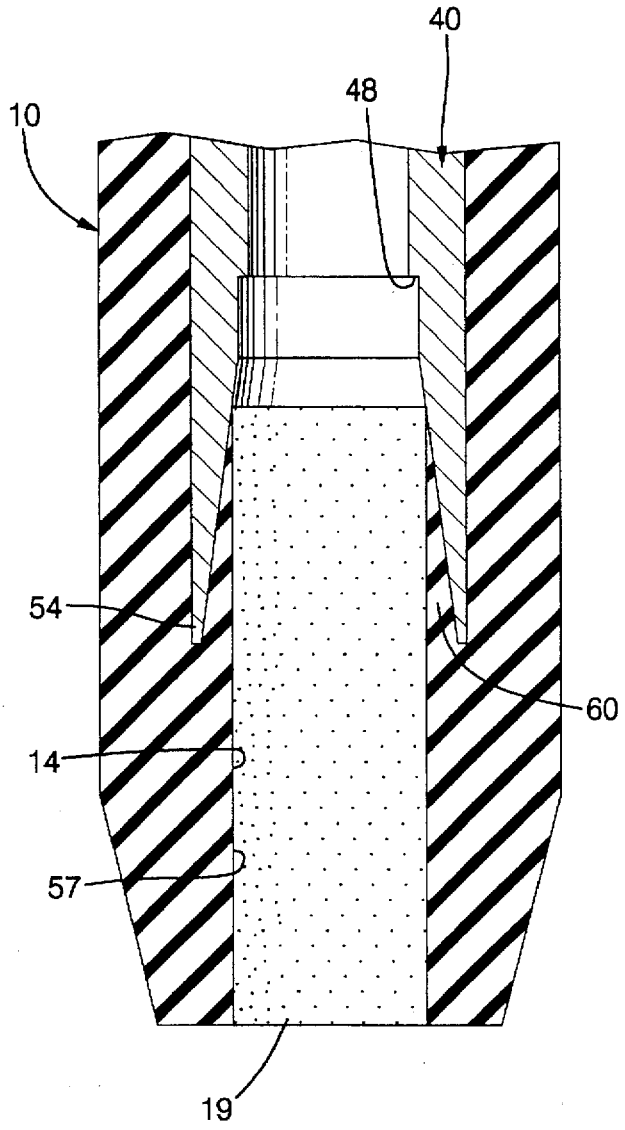
FIG. 3 is an expanded view of the encircled portion of the spark plug boot of FIG. 2.

Referring to FIG. 3, an expanded view of the features of the boot 10 of FIG. 2 within circle "A" are illustrated, with the cylinder 40 insert molded into the interior wall 57 of lower bore 14, with flared lower cylinder end 54 within the elastomer at boot portion 60. Collar seat 48 is provided in the form of a step about the interior wall of cylinder 40.

Figure 4:
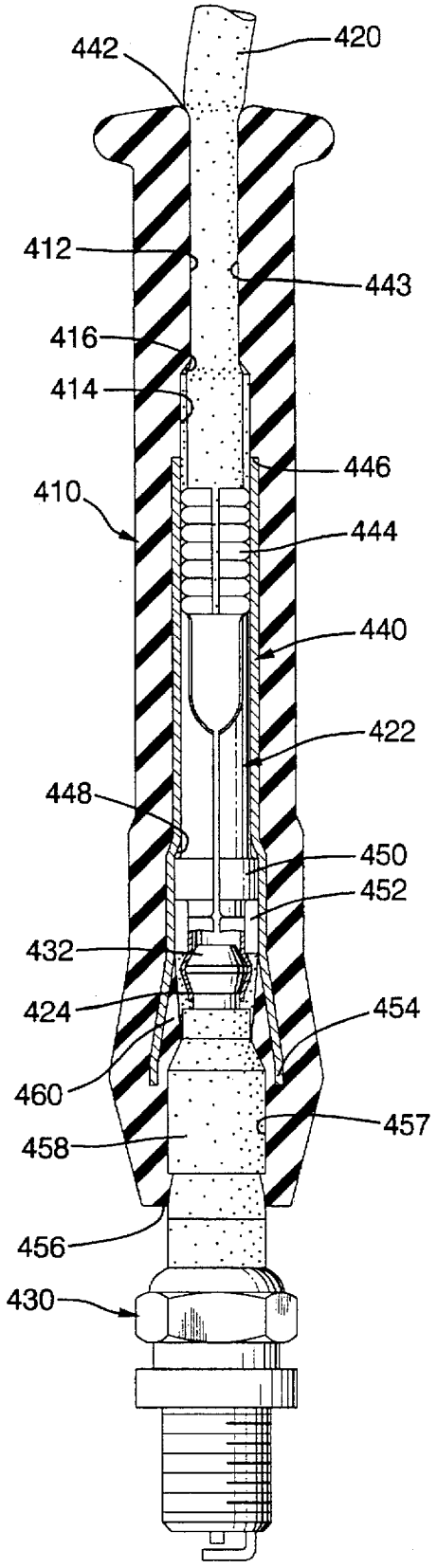
FIG. 4 is a front cutaway diagram of an assembly of an alternative spark plug boot embodiment with a spark plug and ignition cable.

Referring to FIG. 4, a front cutaway diagram of an alternative embodiment of the spark plug boot assembly of the present invention is illustrated including an installation of elastomeric spark plug boot 410 with spark plug 430 having ceramic insulator 458 extending outward therefrom and from the top of which extends spark plug post 432, assembled with ignition cable 420 or alternatively with a dedicated ignition coil (not shown). Spark plug boot 410 has a central longitudinal bore including an upper bore 412 (see FIG. 5) and a lower bore 414 (see FIG. 5) of slightly greater diameter than upper bore 412 with tapered bore section 416 therebetween. The upper bore 412 is of diameter matched with the outer diameter of the insulating jacket of cable 20 to provide for an air-tight, water-tight dielectric seal 442 therebetween to prevent passage of contaminants further into the bore 412. The lower bore 414 is of diameter matched with the outer diameter of spark plug insulator 458 such that an air-tight, water-tight dielectric seal 456 is formed therebetween to prevent passage of contaminants further through the lower bore 414.

A flared, electrically conductive hollow metallic cylinder 440 having an upper end 446 and a flared lower end 454 opposing the upper end 446 is insert molded into the lower bore with the internal surface of the cylinder 440 exposed in the lower bore 414. A molded-in feature is provided in which the flared lower end 454 is molded into the elastomer material of the boot 410, wherein elastomer material of the boot is interposed between the lower end 454 and the lower bore 414. In accord with a critical aspect of this invention, the flared lower end is positioned along a length of the lower bore 414 so as to extend well over the area of electrical connection between snap ring 424 and the spark plug post 432.

Ignition cable 420 is attached to socketed terminal 422 at mechanical crimp section 444 which takes the form described for the previously detailed embodiment. The socketed terminal 422 has a conductive snap ring 424 made of heat treated spring steel sized to snap onto conventional spark plug post 432. Socketed terminal 422 is sized to securely contact the cylinder 440 for robust electrical conductivity therebetween. The mechanical crimp section 444 is internal to the cylinder 440 to relieve electrical field stress on the interface between the cable 420 and the boot 410. Surrounding the socketed terminal 422 and electrically connected thereto is a circular conductive collar 450, positioned along the socketed terminal between the mechanical crimp section 444 and the snap ring 432. The internal surface of the cylinder 440 includes a positioning feature 448 for seating the collar 450 during an assembly process, the positioning feature 448 taking the form of a circumferential collar seat in the form of a step along the otherwise smooth interior surface of the cylinder 440 and positioned along the longitudinal axis of the cylinder between the upper and lower ends 446 and 454, respectively, to mate with the collar 450 when the cable 420 is fully installed within the boot 410. The cylinder 440 further provides a clearance spacing 452 between the boot 410 and the snap ring 424 of the socketed terminal 422 to reduce or eliminate boot damping during assembly which can blur the tactile feel of the positive engagement of the socketed terminal with the spark plug post 432.

Figure 5:
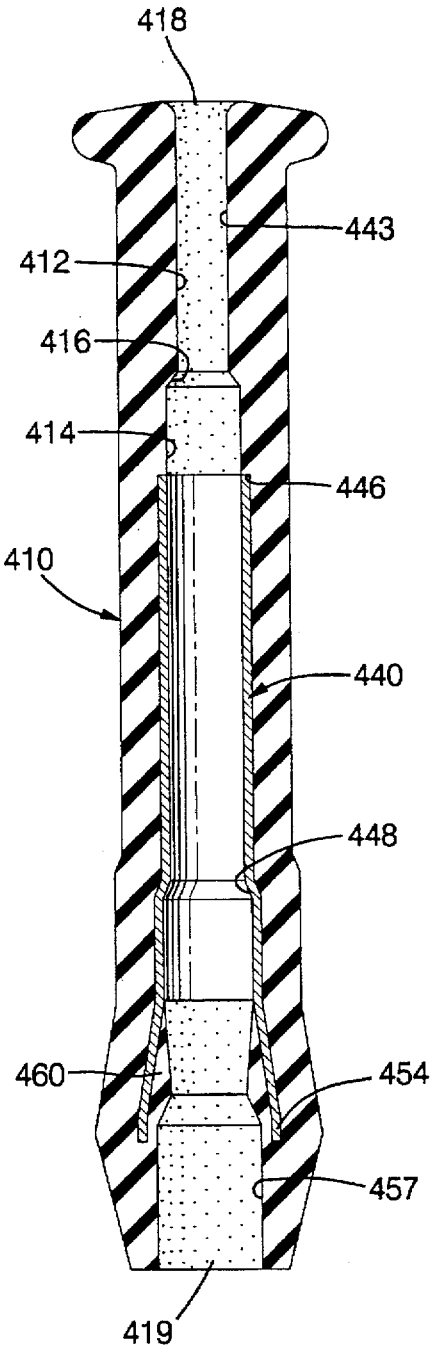
FIG. 5 is a front cutaway diagram of the spark plug boot of FIG. 5.

Referring to FIG. 5, a front cutaway view of the boot 410 of FIG. 4 for better illustrating features thereof details upper bore 412 which forms an upper aperture 418 at the boot top for receiving an ignition cable 420 (FIG. 4) during an assembly procedure with the insulating jacket of the cable sealingly associated with an interior wall 442 of the upper bore 412. The interior wall 442 of the upper bore 412 graduates along tapered bore section 416 to a lower bore 414 of increased diameter and defined by lower bore wall 457 for sealed engagement with the insulator of a spark plug 430 (FIG. 4), as described. The lower bore 414 forms a lower aperture 419 at the boot bottom for receiving the spark plug 430 (FIG. Hollow, flared, electrically conductive cylinder 440 is insert molded in the interior of the lower bore 414 against the lower bore wall 457 with an upper end 446 well above the mechanical crimp section 444 (FIG. 4) and with flared lower end 444 molded into the interior of the elastomeric material of the boot 410, wherein the boot 410 material is interposed at position 460 between the flared lower end 444 and the lower bore 414. The internal surface of the cylinder 440 includes a positioning feature 448 for seating the collar 450 (FIG. 4) during an assembly process, the positioning feature taking the form of a circumferential collar seat 448 along the otherwise smooth interior surface of the cylinder 440 and positioned along the longitudinal axis of the cylinder between the upper and lower ends 446 and 454, respectively, to mate with the collar 450 (FIG. 4) when the cable 420 (FIG. 4) is fully installed within the boot 410.

Figure 6:
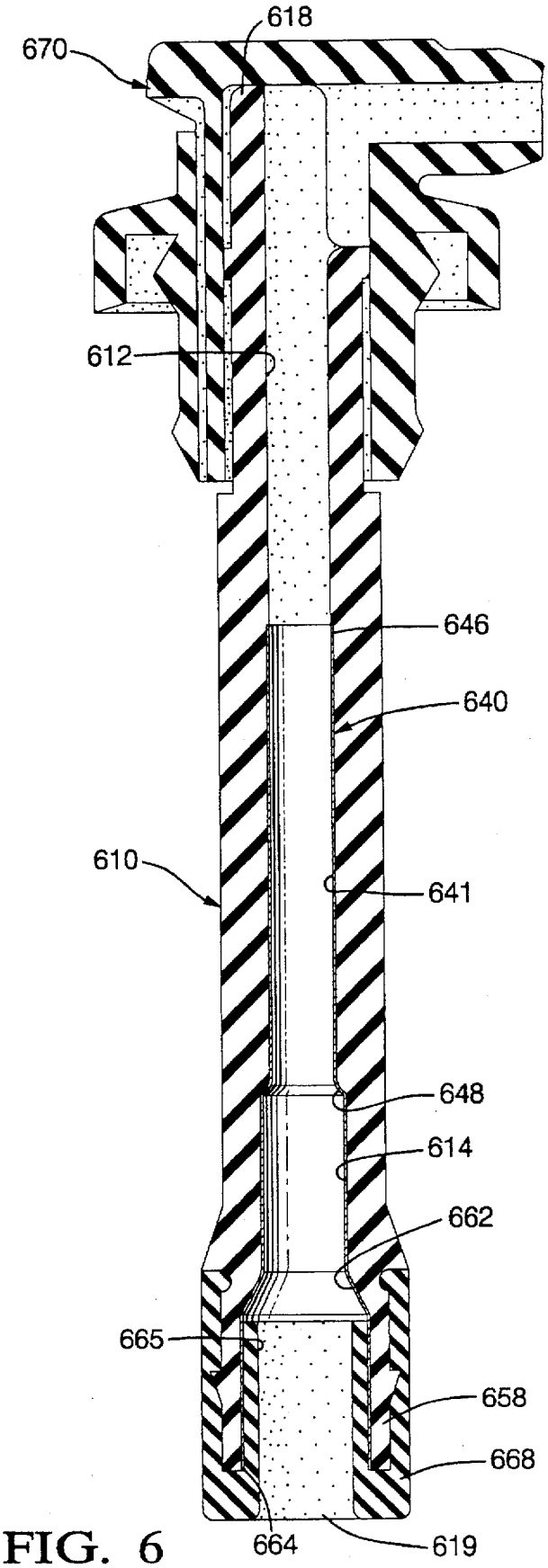
FIG. 6 is a front cutaway diagram of an alternative spark plug boot in accord with this invention.

Referring to FIG. 6, a front cutaway view of an alternative embodiment of the spark plug boot 10 in accord with this invention which may be assembled with, for example, the described spark plug 30 and ignition cable 20 including socketed terminal 22, mechanical crimp section. 44, collar 50, and snap ring 24 of FIG. 1. FIG. 6 illustrates an implementation of the boot 610 with ignition cable extending from the boot at an upper boot end 618 through an L-shaped boot head 670 of any conventional design extending from the boot 610 at an angle of about ninety degrees from the longitudinal axis of the boot 610. Further, the ignition cable may extend from the boot end 618 through a boot head modified to provide for an angled cable assembly, such as with an angle of between 90 and 180 degrees between the cable and the longitudinal axis of the boot 610, through boot head design modifications generally understood in the art. indeed, an angled boot head, such as the L-shaped boot head 670 may be applied, through the exercise of ordinary skill in the art, to any of the boot assembly embodiments within the scope of this invention including the assemblies of FIGS. 1 and 4.

Returning to FIG. 6, boot 610 includes upper bore 612 having diameter matched with the outer diameter of an ignition cable insulating jacket to provide for a sealed interface with the cable upon assembly therewith. The upper bore 612 graduates into an increased diameter lower bore 614 at a circumferential bore step 648. The interior boot wall defining the lower bore 614 includes outward tapered section 662 which opens the bore into a relatively large diameter bottom boot section 658. A length of an interior boot wall 641 is coated with a conventional electrically conductive coating or conductive sleeving material 640. The coated interior wall extends from top position 646 to bottom position 664 and overlaps a length of the upper bore 612 and the entire bottom boot bore 624 including the entire bottom boot section 658. The coating 640 is of a substantially common depth along its entire length and provides for a graduation in diameter at circumferential step 648 for seating a collar (not shown) disposed circumferentially about the socketed terminal assembled into the boot, as described for the socketed terminal 22 and collar 50 of FIG. 1. A hollow boot endcap 668 made, in this embodiment, of elastomeric material is slideably installed on the bottom boot section 658 with an inner diameter matched with the outer diameter of spark plug insulator (not shown) for sealable assembly therewith, having an endcap bore 656 terminating in bottom aperture 619 for receiving such spark plug during a boot attachment procedure. A continuous conductive coating therefore is provided over the bore sections in which electrical ignition interface is provided, reducing electrical mechanical and dielectric stress and thereby increasing boot and terminal life in accord with this invention.

Figure 7:
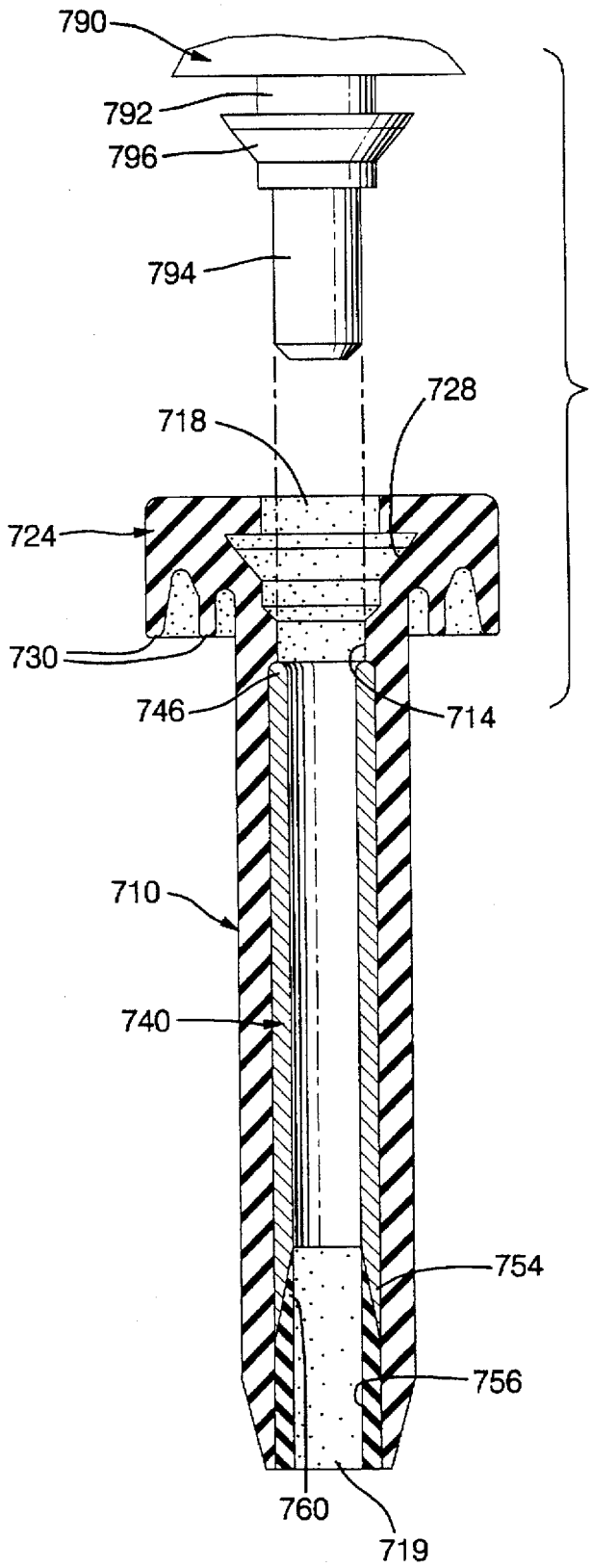
FIG. 7 is a front cutaway diagram of a spark plug boot in an ignition coil-at-plug embodiment of this invention.

Referring to FIG. 7, a front cutaway view of a coil-at-plug embodiment of this invention is illustrated with spark plug boot assembly 710 having central bore 714 forming an upper aperture 718 at the boot top for receiving an high voltage coil terminal 794 extending outward from a flanged coil secondary tower 792 of an ignition coil 790. Tapered flange 796 is disposed on the secondary tower 792 to be securely, sealingly seated within matching cavity 728 of the boot 710 when coil 790 is installed with boot 710. A central bore wall 756 is sized for sealed engagement with the insulator of a spark plug (not shown). The central bore 714 forms a lower aperture 719 at the boot bottom for receiving the spark plug. Hollow, flared, electrically conductive cylinder 740 is insert molded in the interior of the central bore 714 against the bore wall 756. The cylinder 740 includes a flared lower end 754 molded into the interior of the elastomeric material of the boot 710, wherein the boot 710 material is interposed at position 760 between the flared lower end 754 and the lower bore wall 756. The boot 710 is installed on the spark plug with the spark plug post (not shown) extending through the central bore to a position within the cylinder 740 above the flared lower cylinder end 754. An electrically conductive coil spring (not shown) may be inserted into the central bore 714 entirely within the cylinder 740 to electrically contact the spark plug post on a lower spring end (not shown) and, when the coil secondary tower 794 is fully inserted into the central bore, to electrically contact the tower 794 on an upper spring end to provide for electrical conduction between the tower and the spark plug post. The secondary tower is designed to extend well within the interior of the cylinder 740 when the flange 796 is seated within cavity 728, such that the electrical connection between the secondary tower 794 and the coil spring is well within the interior of the cylinder 740, to provide for electrical stress relief in accord with the above-described advantages of this invention. Likewise, the electrical connection between the coil spring and the spark plug post is well within the interior of the cylinder 740 to provide for such advantages. The boot 710 may further include elastomeric fingers 730 to provide for sealing engagement with a spark plug well when the boot 710 is installed on the spark plug.

Several alternatives to the above-described embodiments are within the scope of this invention including altered geometries and variations in materials, such as incorporation of the conductive cylinder of the above embodiments into a rigid spark plug interface assembly of thermoplastic or thermoset construction, through a generally understood insert molding or press fit process.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. A shielded spark plug boot assembly, comprising:

a tubular boot having an interior wall forming a central bore through the boot along the longitudinal axis of the boot with an upper boot end portion for receiving an ignition signal conductor terminating in a socketed terminal and with a lower boot end portion for receiving a spark plug having an insulator portion from which extends a spark plug post, the lower boot end portion sized to seal against the insulator portion; and a hollow, cylindrical, electrically conductive shield sized to securely fit within the central bore and having opposing upper and lower shield ends, the upper shield end for receiving and extending over the socketed terminal and the lower shield end for receiving and extending over the spark plug post.

2. The shielded spark plug boot assembly of claim 1, wherein the tubular boot is made of elastomer material and wherein the lower shield end is flared through the interior wall of the tubular boot.

3. The shielded spark plug boot assembly of claim 1, further comprising:

a collar surrounding a portion of the socketed terminal and secured thereto, and wherein the shield further includes a circumferential collar seat laterally disposed on an interior shield surface between the upper and lower shield ends and sized to receive the collar when the socketed terminal is in a full insertion position within the shield.

4. The shielded spark plug boot assembly of claim 1, wherein the shield comprises a metallic cylinder secured to the interior boot wall and wherein the lower shield end is flared outward through the interior boot wall.

5. The shielded spark plug boot assembly of claim 4, wherein the boot is made of elastomer material aand wherein the elastomer material covers the flared lower shield end.

6. The shielded spark plug boot assembly of claim 4, further comprising:

a circumferential seat on an interior surface of the shield between the upper and lower shield ends; and a circumferential edge about the socketed terminal sized to be received in the seat when the socketed terminal is in a full insertion position within the shield.

7. The shielded spark plug boot assembly of claim 1, wherein the socketed terminal includes a crimp section for attaching the socketed terminal to the ignition signal conductor, and wherein the shield extends over the crimp section when the socketed terminal is in a full insertion position within the shield.

8. A spark plug boot assembly through which an ignition cable terminating in a socketed terminal is electrically linked to a spark plug having an insulator section from which extends a spark plug post, comprising:

a hollow tubular boot having a passage therethrough surrounded by an interior boot wall, the passage terminating, at a first boot end, in a cable end portion sized to receive the ignition cable and terminating, at a second boot end opposing the first boot end, in a spark plug end portion sized to receive a spark plug and to seal against the spark plug insulator; and a metallic cylinder securely attached to the interior boot wall and having an upper cylinder end sized to receive the socketed terminal, the cylinder further having a flared lower cylinder end opposing the upper cylinder end and sized to receive the spark plug post, the flared lower cylinder end extending through the interior boot wall when the metallic cylinder is attached to the interior boot wall.

9. The spark plug boot assembly of claim 8, wherein the boot is made of elastomer material and the cylinder is press fit to the interior boot wall with the flared lower cylinder end extending through the interior boot wall so that elastomer material covers the flared lower cylinder end.

10. The spark plug boot assembly of claim 8, further comprising:

a circumferential seat disposed on an interior surface of the metallic cylinder between the upper and lower cylinder ends;

a collar about a circumferential portion of the socketed terminal and sized to seat within the circumferential seat when the socketed terminal is in a full insertion position within the cylinder.

11. The spark plug boot assembly of claim 8, wherein the socketed terminal includes a crimp section for connecting the ignition cable to the socketed terminal, and wherein the metallic cylinder is further sized to extend over the crimp section when the socketed terminal is in a full insertion position within the cylinder.

12. The spark plug boot assembly of claim 8, wherein the boot is made of thermoplastic material and wherein the cylinder is insert molded onto the interior boot wall with the flared lower cylinder end extending through the interior boot wall so that thermoplastic material covers the flared lower cylinder end.

* * * * *